US006668818B2

(12) United States Patent
Bossler

(10) Patent No.: US 6,668,818 B2
(45) Date of Patent: Dec. 30, 2003

(54) SAFETY GUARD FOR PATIO HEATER

(75) Inventor: Martin C. Bossler, Spring Grove, IL (US)

(73) Assignee: CPD Associates, Inc., Winston-Salem, NC (US)

( * ) Notice: Subject to any disclaimer, the term of this patent is extended or adjusted under 35 U.S.C. 154(b) by 0 days.

(21) Appl. No.: 09/934,983

(22) Filed: Aug. 22, 2001

(65) Prior Publication Data

US 2003/0056783 A1 Mar. 27, 2003

(51) Int. Cl.[7] ..... F24C 15/36

(52) U.S. Cl. ..... 126/92 AC; 126/92 B; 126/91 R

(58) Field of Search ..... 126/92 B, 91 R, 126/92 AC, 544; 431/343, 344, 347; 119/310; 392/432, 433, 422, 426

(56) References Cited

U.S. PATENT DOCUMENTS 3,033,982 A * 5/1962 Burns ..... 362/376
4,063,876 A * 12/1977 Schweiss ..... 431/344
5,237,788 A * 8/1993 Sandow ..... 52/200
5,725,303 A * 3/1998 Lin ..... 362/376
6,102,031 A * 8/2000 Waters ..... 126/92 AC
D445,889 S 7/2001 Resmo et al. ..... D23/386
6,446,623 B1 * 9/2002 Resmo et al. ..... 126/92 R
D466,993 S * 12/2002 Chang ..... D23/336

FOREIGN PATENT DOCUMENTS

FR 2 764 677 A * 12/1998

OTHER PUBLICATIONS

Merriam Webster's Collegiate Dictionary, Tenth Edition (1996), p. 512.*

* cited by examiner

*Primary Examiner*—Josiah Cocks
(74) *Attorney, Agent, or Firm*—Greer, Burns & Crain, Ltd.

(57) ABSTRACT

The present invention provides a dome guard for a dome cover having an inside surface, an outside surface and a rim. The dome guard includes a heat resistant grid, at least one standoff for holding the dome guard a first predetermined distance from the dome cover, and a clip for engaging the inside rim of the dome cover. Contact of human skin with the rim of the dome is limited by the clip, which holds the dome guard a second predetermined distance from the inside rim of the dome.

16 Claims, 8 Drawing Sheets

Fig. 4
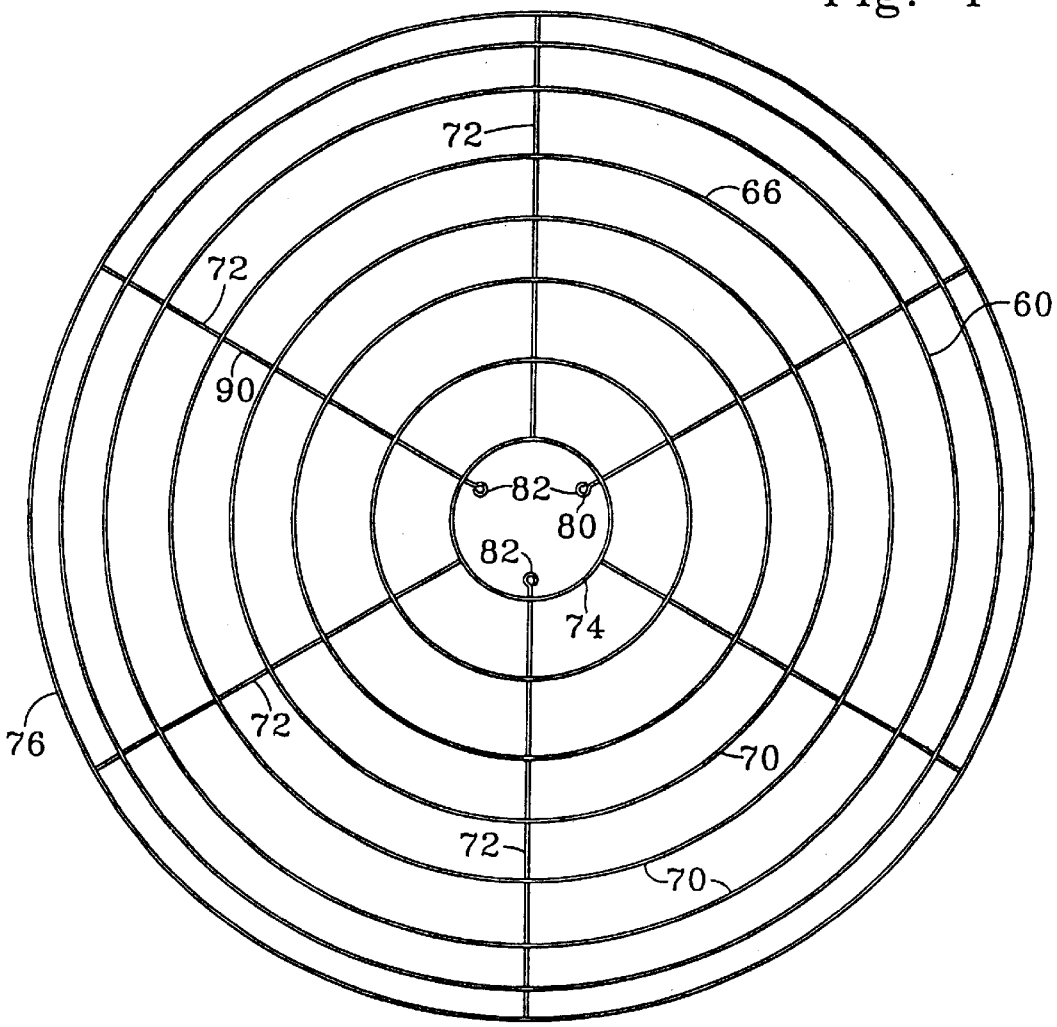
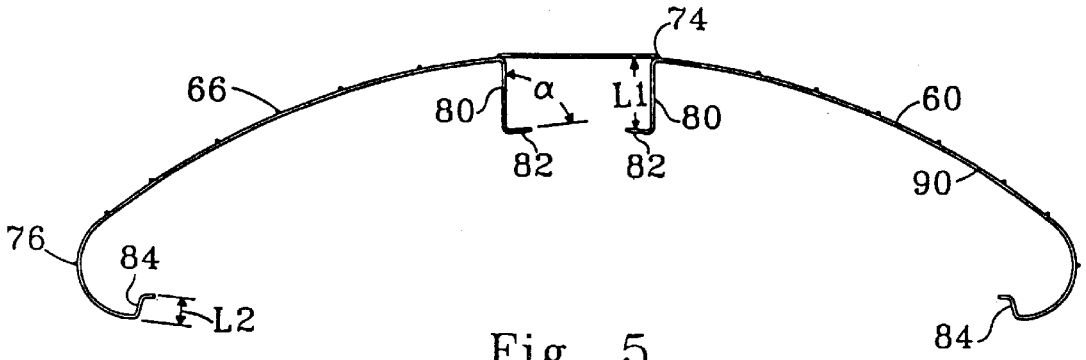
Fig. 5

SAFETY GUARD FOR PATIO HEATER

FIELD OF THE INVENTION

This invention relates to a safety guard for a heating apparatus. More specifically, it relates to a guard that covers both the emitter and dome lid, providing additional protection compared to guards that allow the dome lid or the top of the emitter to remain exposed.

BACKGROUND

High efficiency heating apparatuses are available for warming a preselected outdoor area. It has become fashionable to sit outdoors, on a patio, deck or other open space, using a patio heater to supply warmth when the evening becomes chilly. Generally the units comprise a propane tank, a standard that holds an emitter a sufficient distance from the ground, a burner to support the combustion or propane and a dome cover. The dome reflects much of the heat due to both convection and radiation downward toward the persons trying to keep warm. Details of preferred patio heaters are described in U.S. Pat. No. 6,102,031, U.S. Ser. No. 09/640,199, and U.S. Ser. No. 29/143,937 herein incorporated by reference.

Persons seated around a table, however, may not receive the full benefit of the heating apparatus because of their location. If the standard is tall enough to provide heat over the heads of standing persons, the heat may dissipate before it gets low enough to fully benefit those sitting down. Mini-heaters, that rest on a table top, have become popular for such situations. These smaller heaters use a shorter standard, keeping the warm air at a lower level.

One shortcoming of patio heaters is that the emitter and the dome become very hot due to contact with the hot gasses generated by combustion of the propane. Hot gasses from the emitter have a tendency to rise, and collect under the concave dome covers most commonly found on patio heaters. As the hot gasses are trapped by the dome and cannot rise to escape, heat transfers from the hot gasses to the dome. When there is no wind to carry the heat away, the dome can reach temperatures of several hundred degrees. If the hot surfaces are touched by accident or by curious children who are unaware of the danger, serious burns could result.

The prior art provides guards for an emitter of a portable heater. Design of emitter guards is specified in safety standards, such as Canadian Standards Association ("CSA") Standard 5-90US for gas fired infrared patio heaters. With guards or other protective devices in place, any heater surface that is accessible by a conical probe 5½ inches in length and up to 2¾ inches in diameter shall not exceed 180° F. above ambient temperature. Surfaces are also required to be cool enough that clothing does not ignite when brought in contact with the heater. The standard currently excludes any surface that is located more than 6.5 feet above the ground, which excludes the dome of most full size heaters. Conventional patio heaters with high standards are tall enough to provide some protection from touching of the dome under normal circumstances. Both the dome and the emitter are out of the reach of children, and are generally over the head of most standing adults.

There are times, however, when it is possible to touch the dome of an outdoor heater. After use, for example, two users may tip the unit, with one of them grabbing the dome to move it to a different location. The dome of a mini-heater may be within the reach of a curious child climbing on a picnic table. When located on a table top, the dome of a mini-heater is at a height of approximately six feet, within the reach of most adults, and within the range of surfaces tested according to the CSA standard 5-90US.

These, as well as a number of other examples, demonstrate the need to protect consumers from touching the dome of a portable heater. There is currently no standard providing a guard for the dome of a patio heater, and none are known in the prior art.

It is therefore an object of this invention to provide an improved guard for a portable heater that limits access to the surface of the dome cover.

It is another object of this invention to provide an improved guard for a table top gas fired patio heater that meets the requirements of CSA standard 5-90US.

It is still another object of this invention to provide an improved guard for a portable heater that limits access to the surface of the entire emitter and dome cover.

It is yet another object of this invention to provide an improved guard for a portable heater that is economical to make and to ship so as to minimize the cost of the safety guard.

SUMMARY OF THE INVENTION

These and other objects are met or exceeded by the present invention which features a dome guard for a dome cover of a heating apparatus. Use of the dome guard, either alone, or together with an emitter guard, reduces the chance of bums resulting from contact of a user's skin with the hot dome cover.

More specifically, the present invention provides a dome guard for a dome cover having an inside surface, an outside surface and a rim. The dome guard includes a heat resistant grid, at least one standoff for holding the dome guard a first predetermined distance from the dome cover, and a clip for engaging the rim of the dome cover. Contact of human skin with the rim of the dome is limited by the clip, which holds the dome guard a second predetermined distance from the rim of the dome.

By enclosing the dome in a wire grid that is maintained a predetermined distance away from the dome surface, access to the surface of the dome is limited and heat has a chance to dissipate in the intervening space. Contact of the hot surfaces, either by a child or by accident, is minimized. Although the dome guard is likely to itself become very warm, the severity of any bums that might result will be greatly reduced compared to touching of the hot surface itself. Further, the temperature of the dome guard would be insufficient to cause clothing to ignite if the clothing came in contact with the dome guard surface. Table top heaters are likely to have the dome surface within the 6½ foot height restriction, below which all of the surfaces must comply with the limitations of the standard. Thus it is important that the design of the dome guard meet requirements of CSA standard 5-90US.

Installation of the dome guard on the dome is also easy using the present invention. When it is desirable to install the dome guard, the dome is removed from the heating apparatus. The dome guard is then oriented with the standoffs against the top outside surface of the dome. The dome guard is then flexed, pushing the rim of the dome guard downward until the clips engage with the rim of the dome, holding the guard in place.

BRIEF DESCRIPTION OF THE DRAWINGS

FIG. 4 shows a top view of the preferred dome guard;

FIG. 5 shows a side cross-section of the dome guard of FIG. 4;

DETAILED DESCRIPTION OF THE INVENTION

Figure 1:
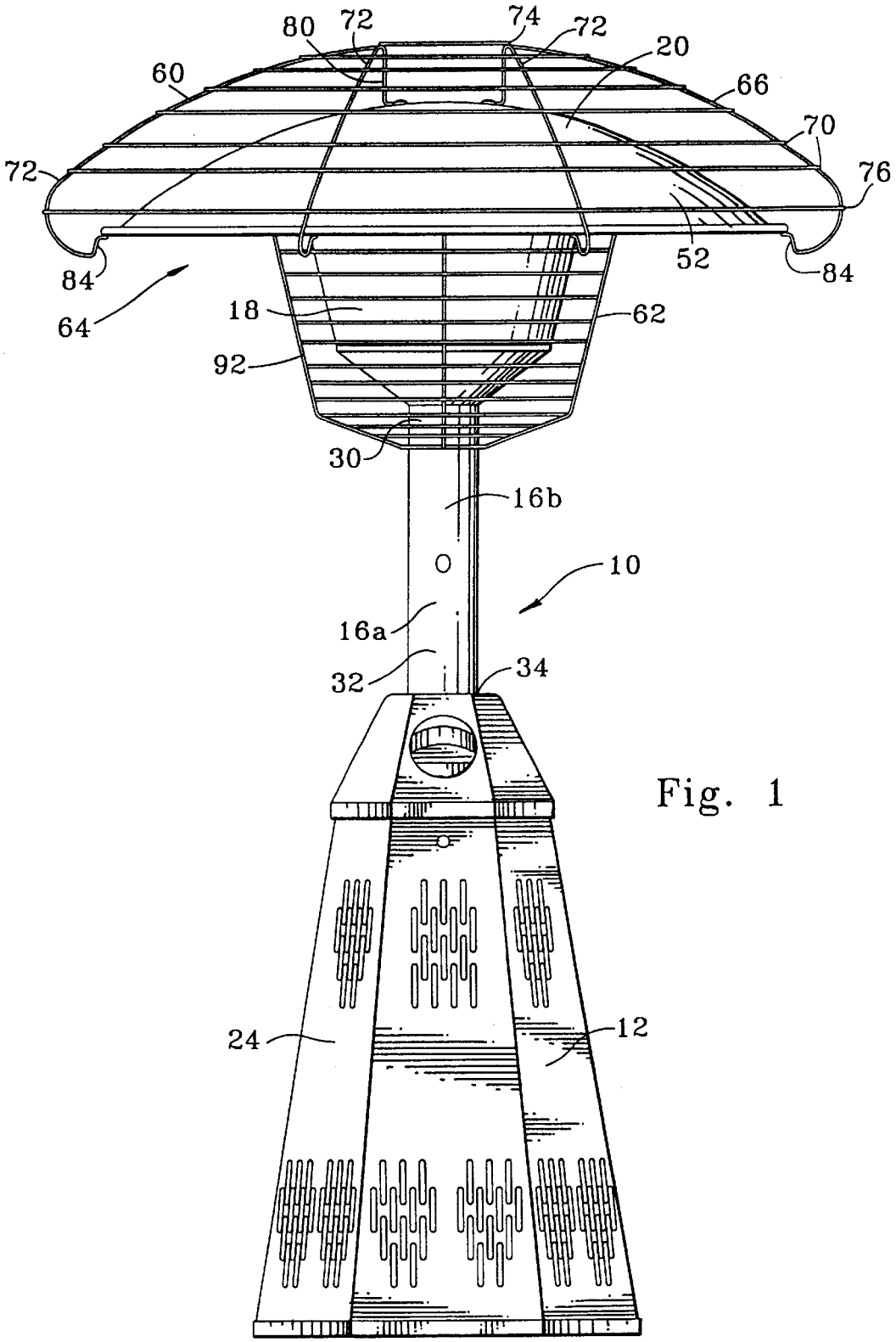
FIG. 1 shows a patio heater with the safety guard of the present invention.

Referring to FIG. 1, a heating apparatus or patio heater, generally designated 10, has a base 12, a fuel source 14 (FIG. 2), a standard 16, an emitter 18 and a dome 20. Preferably these elements are arranged along a longitudinal axis. References to direction used herein are to be interpreted when the heater 10 is oriented as shown in FIG. 1.

Figure 2:
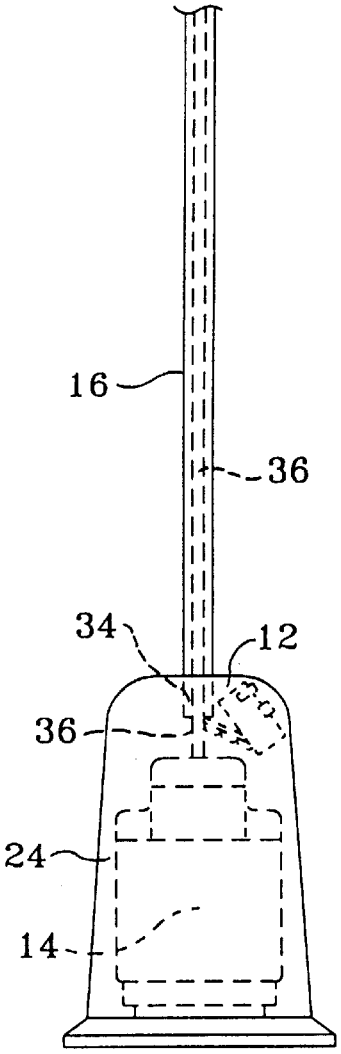
FIG. 2 shows an alternate base with the hidden fuel source and gas line shown in dashed lines.

The base 12 supports the heating apparatus 10, and has suitable weight and contact area with the substrate to provide stability for the heater 10 from tipping over. Preferably, the base 12 is generally cylindrical. An optional shroud 24 is used to cover unsightly portions of the base 12. Space between the shroud 24 and the base 12 is suitable for storage space of any kind, but is particularly convenient for storage of the fuel source 14 as shown in FIG. 2. Optionally, the base 12 rests on a plurality of legs (not shown).

As shown in FIG. 2, the fuel source 14 is preferably a propane tank, however, use of the heater 10 by direct connection to a fuel line is also contemplated. A 20 lb. propane tank is the most preferred fuel source 14 for a full size heater 10 due to ready availablilty and because it contains sufficient fuel that it does not require frequent replacement. Table top mini-heaters 10 are more conveniently transported and lifted to a table top position when the fuel source 14 is a one pound gas cylinder. Storage of the propane tank 14 inside the base 12 removes the unsightly tank from view, and also adds weight to the base, adding to the stability of the heater 10. This invention would also be useful with heaters 10 adapted to operate with alternate fuels, such as butane or white gas.

Figure 3:
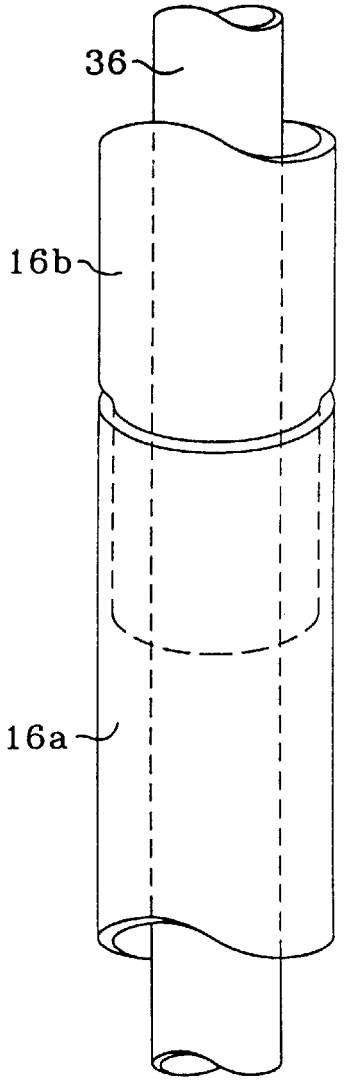
FIG. 3 shows a two-piece standard with a hidden portion of the standard and the gas line shown in dashed lines.

Again referring to FIGS. 1 and 3, the standard or vertical pole 16 for the apparatus can be provided as a single unit or in two or more pole sections 16*a* and 16*b* with a detachable connection therebetween. Further detachable connections similar to that between pole sections 16*a* and 16*b* can be provided at the top 30 of the standard 16 between it and the emitter 18, and at a bottom 32 of the standard 16 where it is tightly received in a central recess 34 formed at the top of the base 12. Support is provided from the base 12 to the standard 16 in the form of a removable connection. Although a solid standard 16 is suitable, preferably the standard is a hollow tube with a gas feed line 36 running up the inside of the tube. The bottom of the gas line 36 is connected to the fuel source 14. When the preferred propane tank 14 is used, it is optionally fitted with a quick disconnect fitting (not shown) for ease in changing the fuel tank 14.

Figure 6:
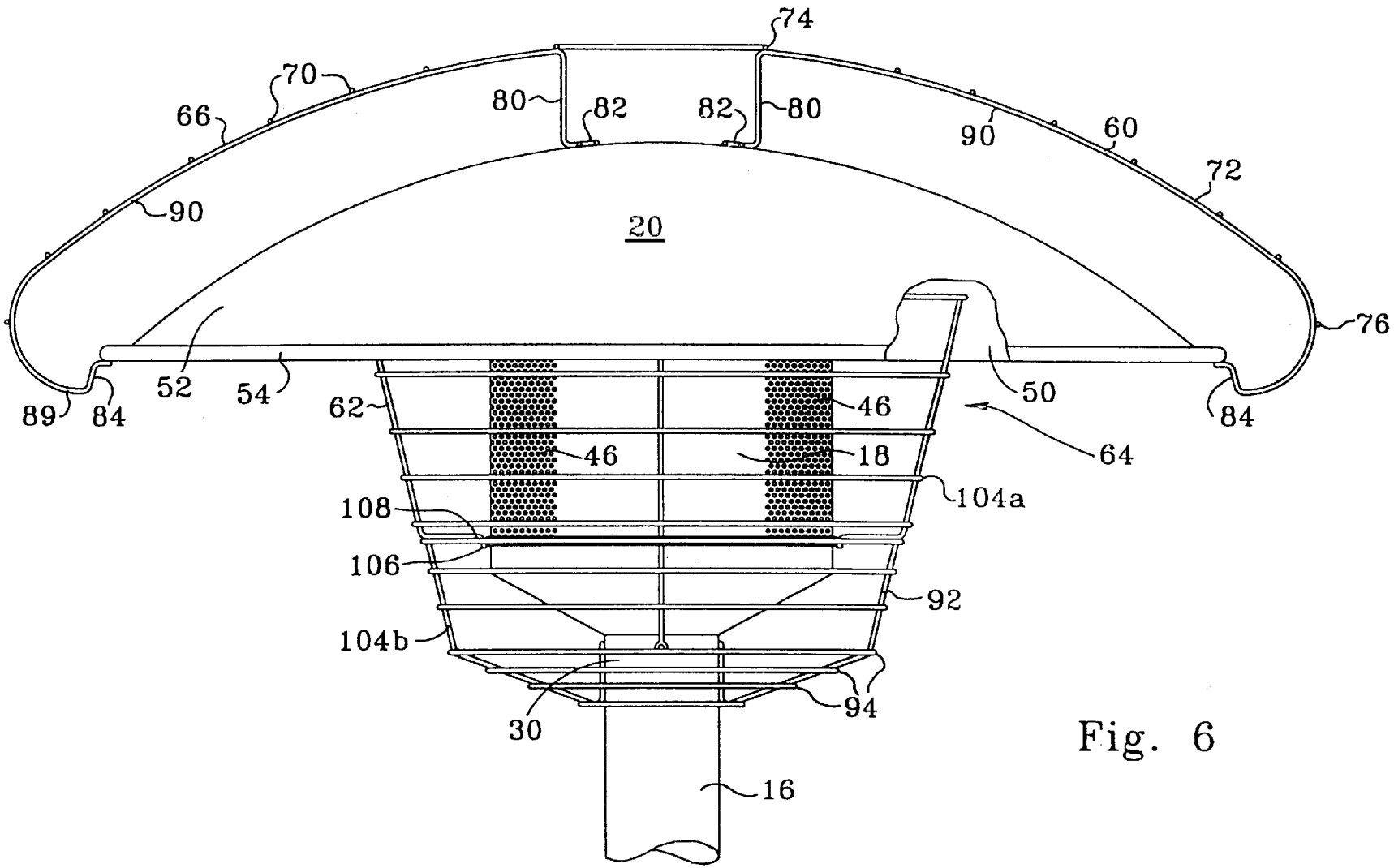
FIG. 6 shows a safety guard utilizing a second embodiment of the emitter guard, showing the dome guard in cross section and having a portion of the dome cover cut away to show the inside.
Figure 7:
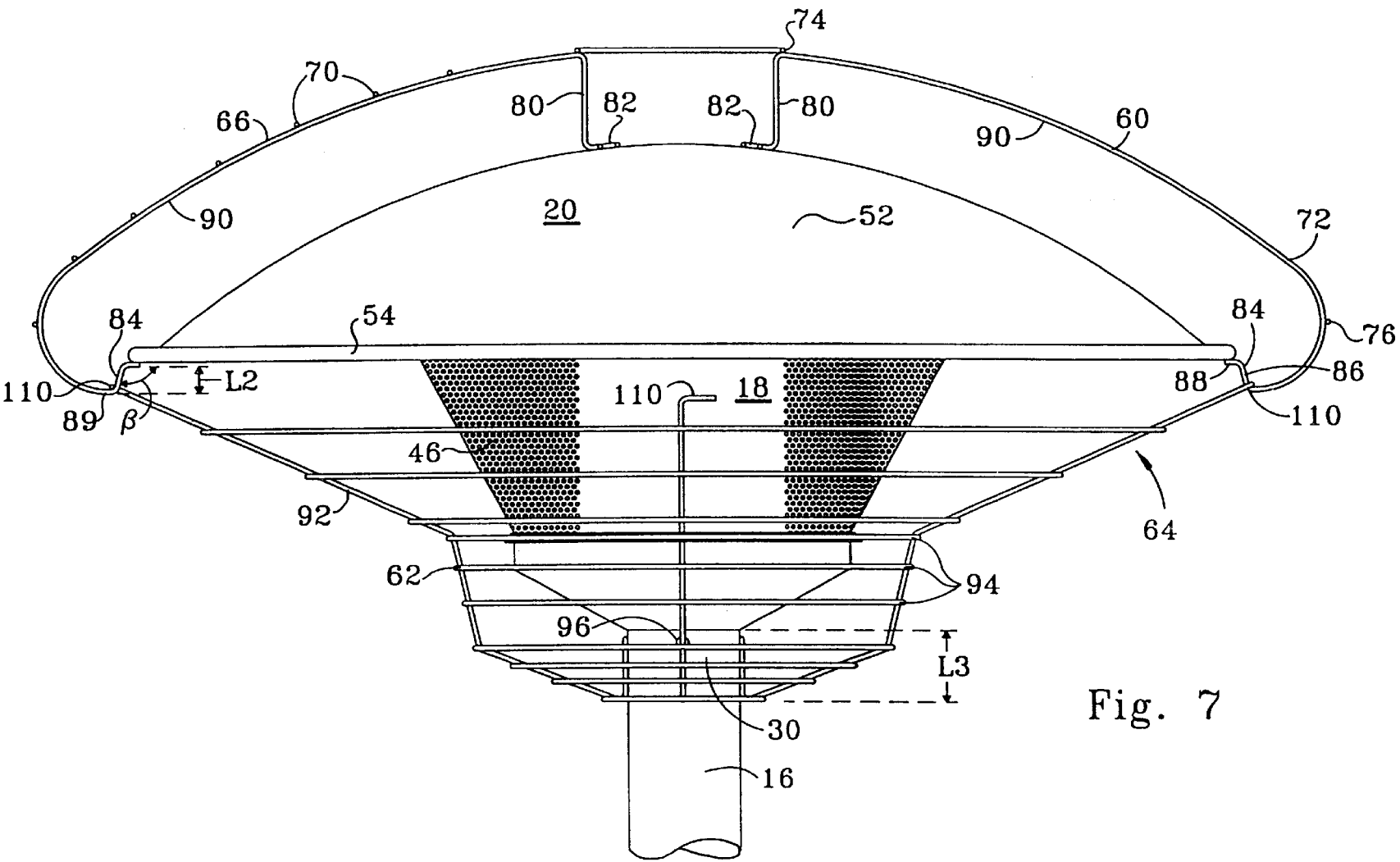
FIG. 7 shows a safety guard utilizing a third embodiment of the emitter guard showing the dome guard in cross section.

Referring to FIGS. 6 and 7, at the top of the standard 16 are a burner (not shown) and the emitter 18. Fuel from the gas feed line 36 is oxidized at the burner, and the hot combustion gasses exit through the emitter 18. The emitter surface 18 includes apertures 46 for directing heat generated by the ignited fuel out away from the burner. The emitter surface 18 is optionally inclined relative to the longitudinal axis (FIG. 7) of the heater 10 so as to direct heat in a generally downward direction about the longitudinal axis for maximum efficiency in warming of a preselected area by the heat emitted from the emitter 18. Angling of the emitter surface 18 so that it is inclined relative to the vertical longitudinal axis of the heating apparatus 10 substantially reduces the need for the large reflector dome as used with prior commercially available patio heaters as heat is directed out away from the burner in a generally downward direction for heating of the preselected outdoor area. Further, because the emitter surface 18 directs heat in the downward direction due to its inclination to the vertical, radiant heat directed straight out radially as with cylindrical apertured emitter surfaces is avoided, minimizing the amount of heat lost over the heads of the users. Cylindrical emitters 18 are also useful. Angling of the emitter surface 18 is less important when a mini-heater is used, as shown in FIG. 6, because the users are closer to the same height as the emitter 18.

Over the top of the burner and emitter 18 is the dome cover 20 that is preferably concave in shape. The dome has an inside 50 and an outside 52 and a rim 54. In a preferred form, the dome cover 20 extends radially beyond the emitter 18 to protect it from exposure to wind and weather. The dome 20 is spaced above the emitter surface 18 along the longitudinal axis to reflect stray radiant heat that rises above the emitter 18 back in the downward direction around the longitudinal axis.

Referring to FIG. 6, a dome guard 60 may be retrofit to a heater 10 with an existing emitter guard 62 or is preferably part of a safety guard, generally 64, designed to fit a particular heater. Usually the safety guard 64 will be made up of a dome guard 60 and emitter guard 62, each as a separate apparatus. However, the construction of the safety guard 64 as a one-piece unit is contemplated. Either the dome guard 60 or the safety guard 64 may comprise one or more pieces. Regardless of the number of pieces, the safety guard 64 is preferably made of a construction that allows for easy assembly and disassembly with minimal use of tools.

Referring now to FIGS. 4 and 5, the dome guard 60 is formed with a flexible, first heat resistant grid 66. Use of the term "heat resistant" is meant to convey that the grid material is suitable to withstand temperatures where it comes in contact with the dome 20 without igniting or losing shape. Metal or wire is the most preferred grid 66 material because of its low cost, ready availability, heat resistance and flexibility. However, the use of any heat resistant, flexible substance is suitable such as high temperature plastics.

Any pattern is suitable for use in the grid 66 that meets CSA standard 5-90US for gas fired infrared patio heaters. Scrolls, flowers and other decorative elements are suitable, as well as a cross-batch pattern or a pattern of concentric rings. For example, if the grid 66 were so open so as to allow a child's hand to slip between the elements of the grid unrestrained it would not be suitable. The most preferable grid 66 is a series of rings 70, made of wire or thin rods and spaced less than 2 inches apart, connected by a series of from about 4 to about 10 radial spokes 72, best seen in FIG. 4. Each of the rings 70 has a center that falls on an imaginary line that would be approximately perpendicular to the circle bounded by a first ring 74. For discussion purposes, the first ring 74 has the smallest diameter and is generally closest to the center of the dome. A last ring 76 is that farthest from the center of the first ring, as measured along the length of the radial spokes 72. The grid 66 of suitably extends at least to the plane parallel to the rim 54 of the dome 20, and preferably extends below that plane to provide some protection from contact with the inside rim 54 of the dome. The spokes 72 are optionally curved or of any shape to form the grid 66 that is approximately parallel to the surface of the dome 20.

At least three functions are performed by the safety dome guard 64. First, it prevents direct contact between people and hot surfaces. Also, by keeping a person's skin predetermined distances from the hot surfaces, the heat has the opportunity to dissipate and be cooled by the environment as it travels over the distances. Finally, it is made of a conductive material, the safety guard 64 will conduct heat away from the hot surface, acting as a heat sink. In the following description, several predetermined distances L1, L2, and L3 are discussed. Choice of the predetermined distances will depend on a balance of the three factors. Specifically, the temperature and location of the hot surface and the conductance of the grid material must be considered in choosing the predetermined distances between the hot surface and the safety guard heater 10. The values of L1, L2 and L3 are selected so that the dome guard 64 conforms with CSA Standard 5-90U5. All three factors must be considered in choosing any of them. L1, L2 and L3 may be the same or different values from each other due to the temperatures and location of the hot surfaces under the safety guard 64.

Referring now to FIGS. 4 and 5, the dome guard 60 has at least one standoff 80 for holding the dome guard at least a first predetermined distance L1, from the dome. Preferably, the standoff 80 is constructed to provide a first predetermined distance of less than about 5 inches. Number and exact placement of the standoffs 80 is entirely discretionary, as long as the purpose of preventing contact with the hot surface of the dome 20 is fulfilled. When the preferred grid 66 arrangement is used, the standoffs 80 are suitably formed by extensions of the radial spokes 72 at the first ring 74.

A mechanism is optionally provided to hold the standoff 80 in place on the dome cover 20. Where the standoff 80 is a metal rod, a depression in the dome slightly larger than the standoff prevents the end of the rod from sliding on the surface of the dome. Preferably, the standoff 80 has a flattened end, or a loop, to form a foot 82 that is at an angle, $\alpha$, to the longitudinal axis of the standoff, increasing contact between the dome guard 60 and the dome 20. Suitable ranges for the angle, $\alpha$, will depend on the exact shape of the dome 20. When a concave dome 20 is used, the preferred range for $\alpha$ is from about 80° to about 90°.

One or more clips 84 are designed to engage the inside rim 54 of the dome 20 and hold the lower portion of the dome guard 60 a second predetermined distance, L2, from the rim of the dome, as shown in FIG. 7. Preferably, the clip 84 includes a shaft 86 and a hook 88. The shaft 86 begins at a bottom 89 of the grid 66, which is beyond the last ring 76 of the preferred grid pattern, and extends toward the rim 54 of the dome 20. The hook 88 is the portion of the clip 84 that contacts the inside rim 54 of the dome 20, and is optionally at an angle, $\beta$, with the shaft 86. $\beta$ varies with the exact shape of the dome 20 and the dome guard 60. If the dome guard 60 extends only to the plane formed by the rim 54 of the dome 20, then a suitable clip 84 would be formed by a shaft 86 and hook 88 entirely within that plane. However, when the preferred dome guard 80 extends below the rim plane, $\beta$ will assume the angle necessary to form a hook 88 that is approximately parallel to the plane formed by the rim 54 when the dome guard 60 is installed on the dome 20. The hook 88 should be configured so that the distance from the tip of the hook to the center of the dome 20 is less than the distance from the rim 54 at the point of contact with the hook 88 to the center of the dome 20.

The preferred clip 84 engages the rim 54 of the dome 20 when the dome guard 80 is downwardly flexed sufficiently to allow the hook 88 to snap around the rim 54 and engage it when the pressure used to flex the dome guard 60 is removed. The dome guard 60 is held in place by upward pressure on the hook 88 as the grid 66 tries to flex back to its unflexed state. The grid 66 pattern and the material of which the grid 66 and clips 84 are constructed are selected to provide enough flex for this installation process. Optionally, the clip 84 is removably secured to the dome guard 60 using a fastener (not shown).

Still referring to FIG. 7, the length of the shaft 86 holds the dome guard in the second preferred distance L2, from the rim 54 of the dome 20. The second predetermined distance L2, is determined by considering the same factors as used to determine the first predetermined distance, as discussed above. Generally, the rim 54 will have a lower temperature than the center of the dome 20 because some of the heat will have dissipated to the environment before it is conducted out to the rim 54. Thus, the second predetermined distance L2, will generally be less than or equal to the first predetermined distance L1. Most preferably, L2 is greater than 0.75 inches but less than 5 inches.

The clips 84 may be attached to the last ring 76 in any suitable manner. Preferably, the clips 84 are formed from extensions of portions of the grid 66, such as the spokes 72. Most preferably, the standoff 80, the spoke 72 and the clip 84 are of unitary construction, with a series of bends to form the various elements. For example, a metal rod 90 is looped to form the foot 82, then bent to form the standoff 80. The standoff 80 is of sufficient length to hold the dome cover 60 the first predetermined distance L1 from the dome 20. At the first ring 74, the rod 90 is again bent to form one of the spokes 72 and continues down the length of the grid 66. Another bend beyond the last ring 76 forms the shaft 86 of the clip 84 having a length, L2, and finally, the hook 88 is formed. Although this example demonstrates a simple and economical method of forming these elements, the foot 82, standoff 80, and clip 84 are suitably made of distinct parts, or even of different materials, and attached to the grid 66, for example by spot welding.

Although the dome guard 60 is suitable for use alone, preferably it is a portion of a safety guard 64 that includes the emitter guard 62. The emitter guard 62 includes a heat resistant grid 92 similar to that used in the dome guard 60. Grid patterns and materials of manufacture suitable for the dome guard are also used for the emitter guard 62. Preferably, the grid 92 pattern includes a series of rings 94 parallel to the emitter surface 18.

Figure 9:
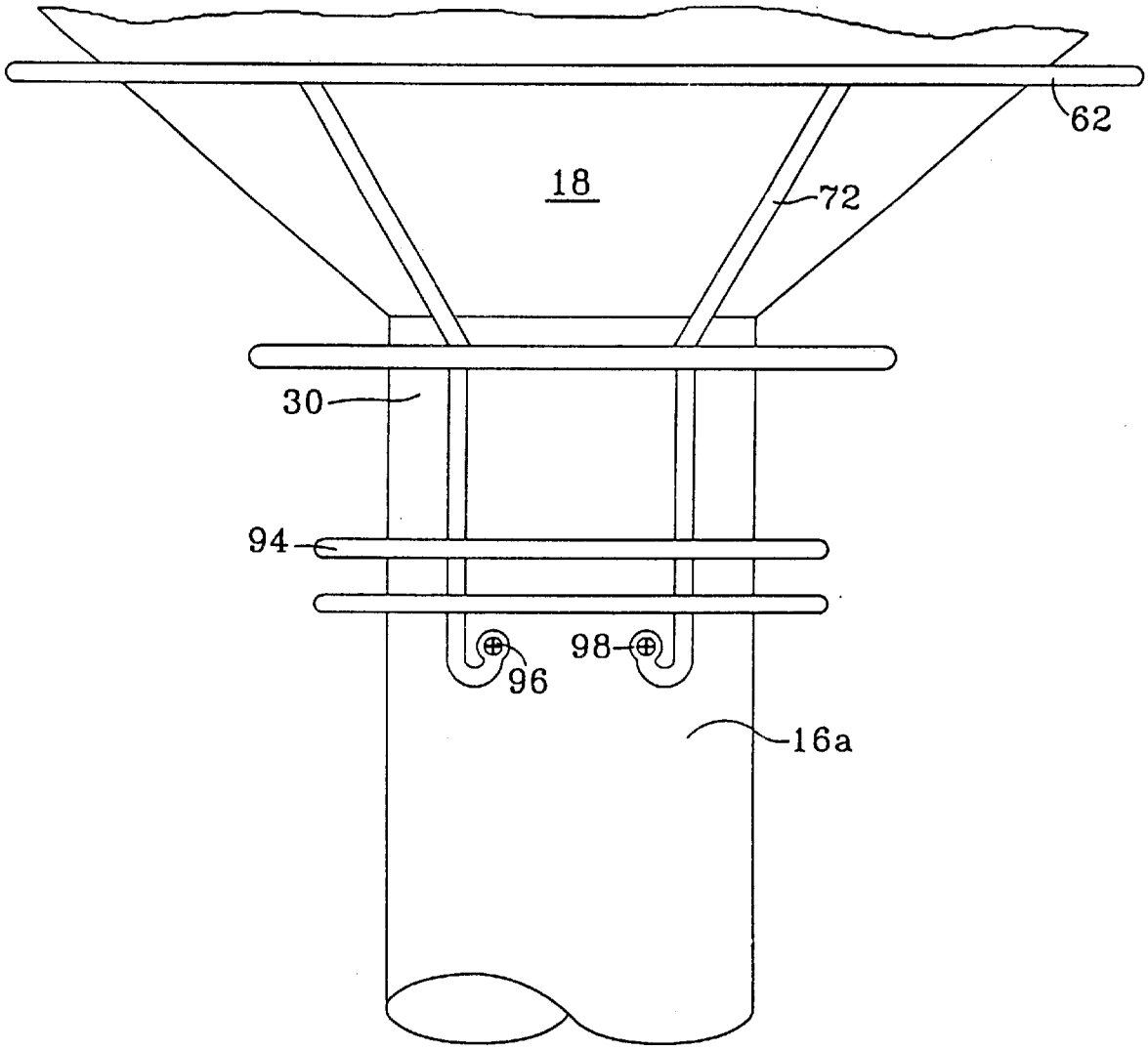
FIG. 9 shows a detail of the preferred method of mounting the emitter guard to the standard.
Figure 10:
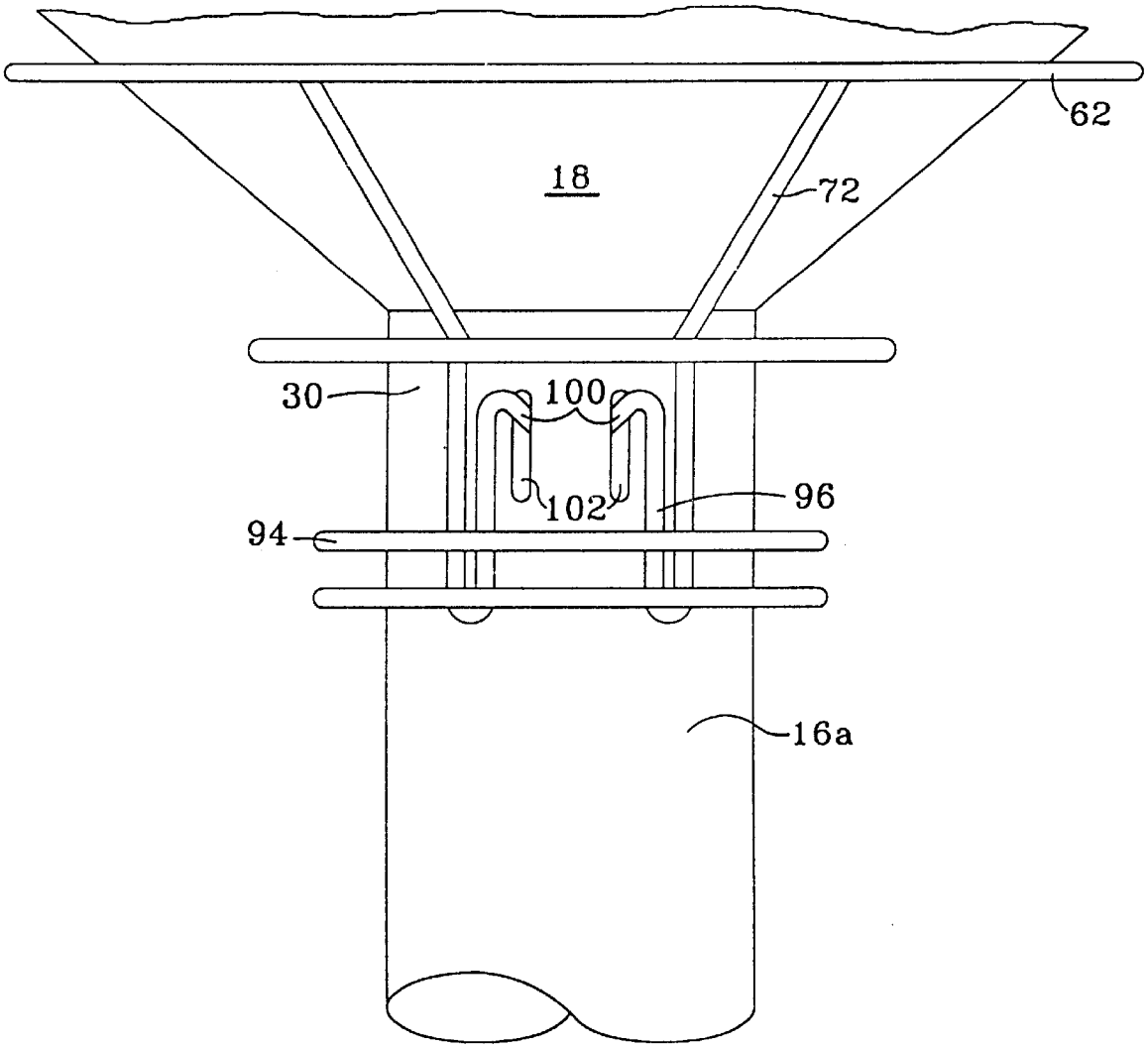
FIG. 10 shows a detail of an alternate method of mounting the emitter guard to the standard.

One or more offset fasteners 96 connect the grid 92 of the emitter guard 62 to the heater 10, shown in FIGS. 9 and 10. Preferably, the grid 92 is removably attached to the standard 16, however it is optionally connected to other parts of the heater 10 or safety guard 64, such as the emitter 18, the dome 20 or the dome guard 60. When attaching the fastener 96 to the standard 16, the preferred fastener 96 (FIG. 9) is a screw that attaches a loop 98 on the emitter guard to a corresponding opening 102 in the standard. Use of the screw 96 is most preferred because, when tightened down, the screw holds the guard 62 firmly in place, reducing the possibility of detaching it from the guard if it is bumped or jostled. Another of the preferred fasteners 96 is a hook 100 that engages the opening 102 having a slotted shape, as seen in FIG. 10. Preferably the fastener 96 is located near the top 30 of the standard 16, just below the base of the emitter 18. However, the exact location of attachment is not critical, and many other locations on the standard 16 or the emitter 18 are suitable. When the hook 100 engages the slot 102 on the standard 16, the weight of the emitter guard 62 is sufficient to hold it in place.

As shown in FIG. 7, when the fastener is engaged with the standard, the fastener 96 is offset to hold the grid a third predetermined distance, L3, downward along the standard 16 from the emitter surface 18. Because the emitter 18 is directly distributing the hot gasses, it is most likely to the hottest exposed surface of the heater. The third predetermined distance, L3, is therefore suitably greater than either the first or second predetermined distances in most cases, but is determined using the same factors as discussed above.

Referring now to FIG. 6, the emitter guard 62 is optionally formed of two or more racks 104 that overlap to form a continuous guard. Two-piece emitter guards 62 are advantageously used to minimize shipping costs where two small pieces can be packed into a smaller space with the heater 10 in the shipping carton. Preferably, each of the racks 104*a*, 104*b* attaches directly to the standard 16 or the emitter 18. Where two or more racks 104*a* and 104*b* are used, the racks optionally connect to each other, either instead of or in addition to any direct connection to the heater 10. A preferred method of removably connecting two racks 104*a*, 104*b* is using a simple hook 106 on one rack that attaches to an eye 108 or any suitable location on the corresponding rack. As shown in FIG. 6, if the eyes 108 are located on the lower rack 104*b*, and the hooks 106 on the upper rack 104*a*, then the weight of the upper rack 104*a* is sufficient to hold the upper rack in place. Where such an arrangement is used, the removable connection between the lower rack 104*b* and the standard 16 is configured to hold the weight of all racks 104*a*, 104*b*. Referring to the alternate embodiment in FIGS. 7 and 8, hooks 110 at the top of the emitter guard 62 removably attach to the dome guard 60 where the clip 84 is attached to the spoke 74 at the bottom 89 of the grid 66.

Figure 8:
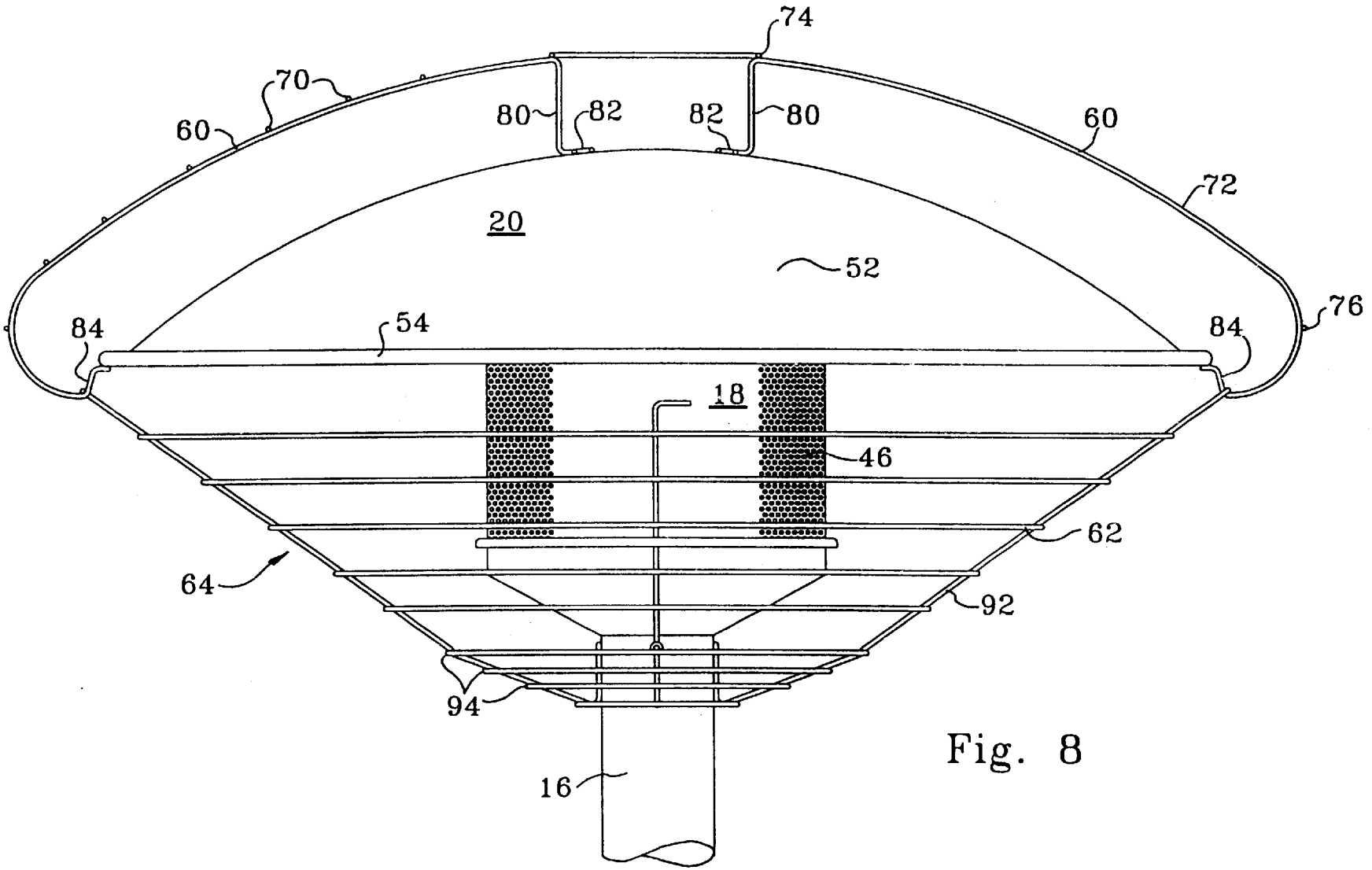
FIG. 8 shows a safety guard utilizing a fourth embodiment of the emitter guard showing the dome guard in cross section.

The overall shape of the emitter guard 62 varies to provide protection as desired. FIGS. 6, 7 and 8 show a several alternate shapes for the emitter guard 62. Most preferably, the emitter guard 62 is shaped so as to provide continuous protection when used with the dome guard 60 as part of a safety guard 64. Two such preferred safety guards are shown in FIGS. 7 and 8. In both cases, the emitter guard 62 approaches the diameter of the dome guard 60, providing protection from contact with the inside surface 50 of the dome cover 20 because there is insufficient space between the dome guard 60 and the emitter guard 62 for contact to accidentally occur.

Features shown in various figures are freely interchangeable with each other. The emitter guard 62 shape shown in FIG. 8, for example, can be used in the two-piece form shown in FIG. 6. None of the features shown in a particular figure is necessarily intended to be limited to the shape of the emitter or other features with which it is shown.

The safety guard 64 is easily installed by the consumer. With the dome cover 20 removed, the emitter guard 62 is oriented to align the offset fasteners 96 with the corresponding opening in the standard 16. The emitter guard 62 is then dropped down over the emitter 18 and removably fastened to the standard 16, preferably by engaging the fasteners 96 on the emitter guard with corresponding openings 102 on the standard 16. If the emitter guard 62 has two or more racks 104*a*, 104*b*, subsequent racks are properly oriented, then removably fastened to the heater 10 or one or more previously mounted racks 104.

Installation of the described dome guard 60 is accomplished entirely by hand and without the need for tools. The dome guard 60 is installed on the dome 20 prior to placement of the dome 20 on the heater 10. The dome guard 60 is oriented with the standoffs 80 placed between the dome 20 and the dome guard 60. With the dome guard 60 generally aligned in the installed position, the dome guard 60 is flexed downward to engage the rim 54 of the dome 20. After installation of the dome guard 60, the dome 20 is replaced on the heater 10. If the dome guard 60 and the emitter guard 62 are interconnected, as in FIGS. 7 and 8, the dome 20 is placed so that the hooks 110 of the emitter guard are placed between the spokes 72 of the dome guard 60. The dome 20 and dome guard 60 are then rotated until the hooks 110 engage the spokes 110 or clips 84 of the dome guard 60.

While a particular embodiment of the present invention has been shown and described, it will be appreciated by those skilled in the art that changes and modifications may be made thereto without departing from the invention in its broader aspects and as set forth in the following claims.

What is claimed is:

1. A dome guard for a dome cover of a heating apparatus, the dome cover having an inside surface, an outside surface and a rim, said dome guard comprising a heat resistant grid of wire arranged in concentric circles and connected by spokes, ac least one standoff for holding said dome guard a first predetermined distance from the dome cover, and a clip for engaging said rim of the dome cover, said clip holding said guard a second predetermined distance from the rim of the dome and said grid being configured and arranged to limit contact with the inside and outside dome surface.

2. The dome guard of claim 1, wherein said second predetermined distance is less than said first predetermined distance.

3. The dome guard of claim 1, wherein said dome guard comprises at least three standoffs.

4. The dome guard of claim 1, wherein said grid is configured and arranged to allow said dome guard to flex sufficiently to engage said clip with the dome.

5. A safety guard for a heating apparatus having a standard, an emitter and a dome, the dome having an inside, an outside and a rim, comprising:

a dome guard including a first heat resistant grid, at least one standoff for holding said dome guard a first predetermined distance from the dome, and a clip for engaging said rim of the dome, said clip holding said guard a second predetermined distance from said rim of said dome; and an emitter guard including a second heat resistant grid and an offset fastener for connecting said grid to the standard, said fastener holding said grid a predetermined distance from the emitter when said fastener is engaged with the standard and wherein said emitter guard is removably attached to said dome.

6. The safety guard of claim 5, wherein said safety guard installs onto the heating apparatus without the use of tools.

7. The safety guard of claim 5, wherein said grids are configured such that access to the entire surface of the emitter and the dome is restricted.

8. The safety guard of claim 5, wherein said emitter guard comprises two or more racks.

9. A safety guard for a heating apparatus having a standard, an emitter and a dome, the dome having an inside, an outside and a rim, comprising:

a dome guard including a first heat resistant grid, at least one standoff for holding said dome guard a first predetermined distance from the dome, and a clip for engaging said rim of the dome, said clip holding said guard a second predetermined distance from said rim of said dome, said first grid comprising thin rods or wire arranged in rings and radial spokes connecting said rings; and an emitter guard including a second heat resistant grid and an offset fastener for connecting said second grid to the standard, said fastener holding said second grid a predetermined distance from the emitter when said fastener is engaged with the standard.

10. The safety guard of claim 9 further comprising hooks on said emitter guard that removably engage said spokes on said dome guard.

11. The safety guard of claim 9, wherein said grid is comprised of metal wires.

12. A heating apparatus with a safety guard comprising:

a standard;

an emitter;

a dome having an inside, an outside and a rim, a dome guard including a first heat resistant grid, at least one standoff for holding said dome guard a first predetermined distance from said dome, and a clip for engaging said inside rim of said dome, said clip holding said guard a second predetermined distance from said inside rim of said dome; and an emitter guard including a second heat resistant grid configured to contain said emitter within said grid and an offset fastener for connecting said grid to the standard, said fastener holding said grid a predetermined distance from said emitter when said fastener is engaged with said standard, and wherein said emitter guard extends from said standard to said dome.

13. The heating apparatus of claim 12, wherein said emitter guard comprises two or more racks.

14. The heating apparatus of claim 12, wherein said emitter guard further comprises one or more hooks, said standard further comprises one or more slots that correspond with said one or more hooks, and said emitter guard is removably attached to said standard by engaging each said hook with said corresponding slot.

15. A dome cover having a dome guard for a heating apparatus, comprising said dome cover having an inside surface, an outside surface and a rim, with said dome guard removably attached thereto, said dome guard comprising a heat resistant grid that comprises rods or wire arranged in concentric circles connected by spokes, at least one standoff for holding said dome guard a first predetermined distance from said dome cover, and a clip for engaging said inside rim of said dome cover, said clip holding said guard a second predetermined distance from said inside rim of said dome and said grid being configured and arranged to limit contact with said inside and outside dome surfaces.

16. A method of reducing the safety hazard in the vicinity of a heating apparatus having an emitter, a standard and a dome having an inside, an outside, and a rim comprising:

orienting an emitter guard, having a first heat resistant grid to contain the emitter within said grid;

engaging said grid with said standard a pre-determined distance from said emitter;

orienting a dome guard having a second heat resistant grid, at least one clip, and at least one standoff such that said standoff is closest to the dome;

placing said standoff of said dome guard against the dome;

flexing said dome guard toward the rim of the dome; and engaging said at least one clip with the rim of the dome.

* * * * *